US005303929A

United States Patent [19]

Sandeen

[11] Patent Number: 5,303,929

[45] **Date of Patent: * Apr. 19, 1994**

[54] NUMBER CARD GAME AND METHOD

[76] Inventor: Lowell Sandeen, Rte. 1, Box 159, McIntosh, Minn. 56556

[ * ] Notice: The portion of the term of this patent subsequent to May 12, 2009 has been disclaimed.

[21] Appl. No.: 881,419

[22] Filed: May 11, 1992

Related U.S. Application Data

[63] Continuation-in-part of Ser. No. 610,847, Nov. 8, 1990, Pat. No. 5,112,058.

[51] Int. Cl.[5] ..... A63F 3/06

[52] U.S. Cl. ..... 273/269; 273/139; 283/901; 283/903

[58] Field of Search ..... 273/138 R, 139, 269, 273/237, 273; 283/901, 903

[56] References Cited

U.S. PATENT DOCUMENTS

| | | | |
|---|---|---|---|
| 2,474,573 | 6/1949 | Cohen | 273/269 |
| 4,475,157 | 10/1984 | Bolan | 273/237 |
| 5,112,058 | 5/1992 | Sandeen | 273/139 |

FOREIGN PATENT DOCUMENTS

| | | | |
|---|---|---|---|
| 434847 | 9/1912 | France | 273/269 |
| 1599305 | 9/1981 | United Kingdom | 273/273 |
| 2190599 | 11/1987 | United Kingdom | 273/269 |

*Primary Examiner*—Benjamin H. Layno
*Attorney, Agent, or Firm*—Lawrence M. Nawrocki

[57] ABSTRACT

A game card for playing rounders or bingo. The game card comprises a matrix having a plurality of polygons interfitted to define a multiplicity of intersections formed by adjacent angular portions of contiguous polygons. Each angular portion of a polygon carries a number or a blank with no number. Alternatively, the game card may also be used for promotional purposes by covering the intersections and numbers surrounding the intersections with a removable opaque coating.

8 Claims, 8 Drawing Sheets

*Fig. 1*

| | | | | |
|---|---|---|---|---|
| 12345 | 21345 | 31245 | 41235 | 51234 |
| 12354 | 21354 | 31254 | 41253 | 51243 |
| 12435 | 21435 | 31425 | 41325 | 51324 |
| 12453 | 21453 | 31452 | 41352 | 51342 |
| 12534 | 21534 | 31524 | 41523 | 51423 |
| 12543 | 21543 | 31542 | 41532 | 51432 |
| 13245 | 23145 | 32145 | 42135 | 52134 |
| 13254 | 23154 | 32154 | 42153 | 52143 |
| 13425 | 23415 | 32415 | 42315 | 52314 |
| 13452 | 23451 | 32451 | 42351 | 52341 |
| 13524 | 23514 | 32514 | 42513 | 52413 |
| 13542 | 23541 | 32541 | 42531 | 52431 |
| 14235 | 24135 | 34125 | 43125 | 53124 |
| 14253 | 24153 | 34152 | 43152 | 53142 |
| 14325 | 24315 | 34215 | 43215 | 53214 |
| 14352 | 24351 | 34251 | 43251 | 53241 |
| 14523 | 24513 | 34512 | 43512 | 53412 |
| 14532 | 24531 | 34521 | 43521 | 53421 |
| 15234 | 25134 | 35124 | 45123 | 54123 |
| 15243 | 25143 | 35142 | 45132 | 54132 |
| 15324 | 25314 | 35214 | 45213 | 54213 |
| 15342 | 25341 | 35241 | 45231 | 54231 |
| 15423 | 25413 | 35412 | 45312 | 54312 |
| 15432 | 25431 | 35421 | 45321 | 54321 |

*Fig. 2*

1, 2, 3, 4, 5
11, 12, 13, 14, 15
22, 23, 24, 25
33, 34, 35
44, 45
55
111, 112, 113, 114, 115
122, 123, 124, 125
133, 134, 135
144, 145
155
222, 223, 224, 225
233, 234, 235
244, 245
255
333, 334, 335
344, 345
355
444, 445
555

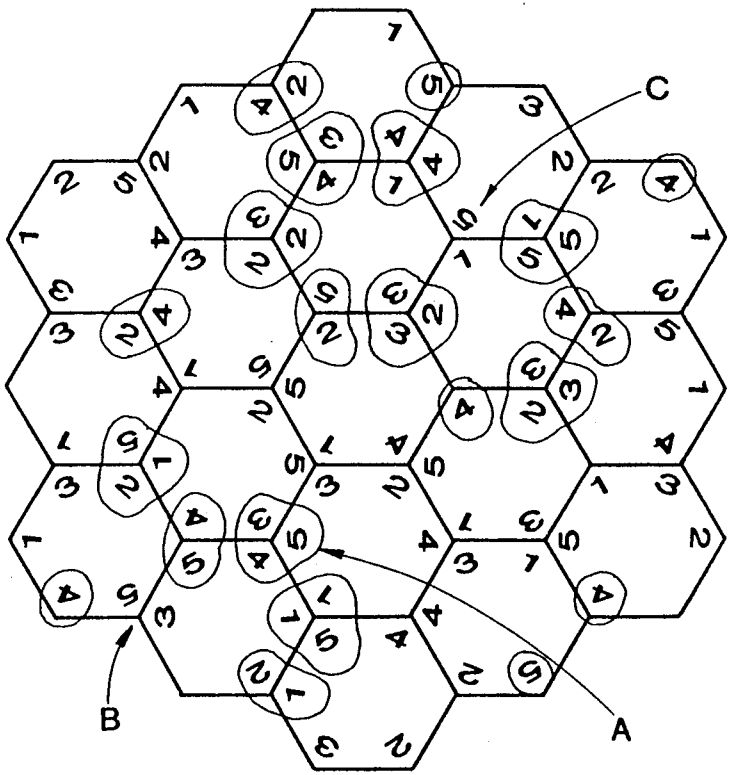
Fig. 4b
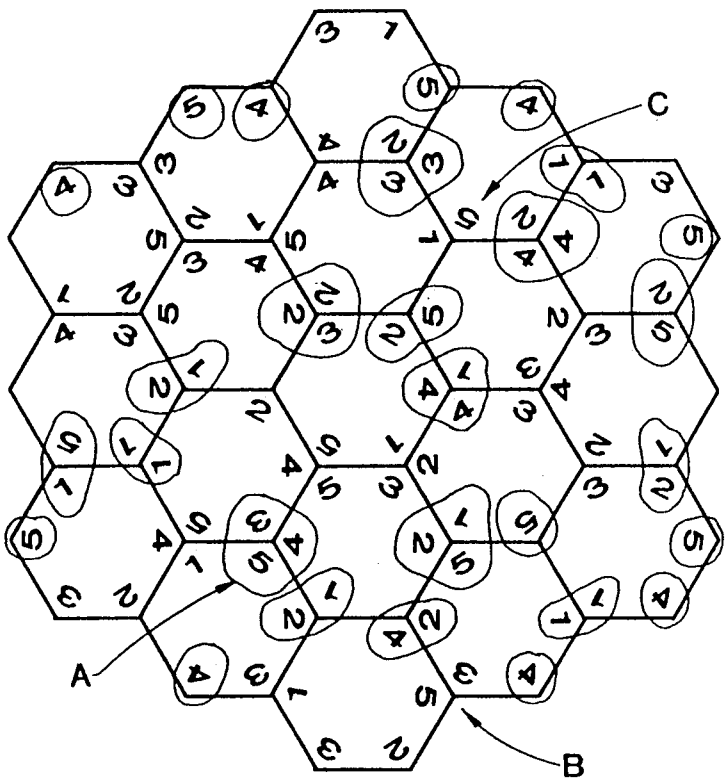
Fig. 4a
Fig. 4c
4-5-11-12-24-25-45-115-125-144-155-223-233-244-345

NUMBER CARD GAME AND METHOD

CROSS-REFERENCE TO RELATED APPLICATION

This is a continuation-in-part of U.S. Ser. No. 07/610,847, filed Nov. 8, 1990 now U.S. Pat. No. 5,112,058.

BACKGROUND OF THE INVENTION

1. Field of the Invention

This invention is in the field of games. More specifically, this invention is in the field of games employing card means or cards having pre-arranged numbers and figures thereon. Yet more specifically, this invention is in the field of game cards having pre-arranged indicia thereon, the indicia deployed in association with selected polygonal matrices having translation symmetry. Yet more specifically, this invention is in the filed of a game called "rounders". This invention may also be used in a method of play analogous to that of bingo. Lastly, in another aspect of the present invention, the present game card is employed in a promotional method wherein portions are "scraped off" to reveal numbers thereunder.

2. Description of the Prior Art

U.S. Pat. Nos. 4,191,376 ("Goldman et al."), 4,491,319 ("Nelson") and 4,671,512 ("Bachman et al.") relate to a latter aspect of the present invention, namely, its utilization in a "scrape-off" game playing method. Goldman et al. describes a game ticket and method of fabricating same used in, for example, a state lottery. A particular variety of lottery ticket and a security system relating thereto are disclosed.

Nelson discloses a game card device which provides an apparatus for a player to play a game of skill. Nelson employs removable opaque coatings to hide, in the first instance, the relationship is between a first plurality of figures as viewed from a first plane and, in the second instance, the relationship is between the figures as viewed from a second plane.

Bachman et al. discloses an automated teller machine receipt having a promotional game on the back side thereof. A selectively removable opaque masking is applied for game indicia on the back side of the ATM receipt.

U.S. Pat. No. 4,611,811 ("Haase") describes a bingo game having the ability to change part of the bingo pattern. Specifically, Haase discloses manual and electronic embodiments of his improved bingo game wherein the player is permitted to change the bingo pattern while the game is being played by rotating (either manually or electronically) the sixteen squares located in groups of four at each of four corners of the card.

U.S. Pat. No. 4,830,380 (Six) discloses an apparatus method and sheet which permits a vastly increased number of bingo cards to be printed and distributed without duplication.

None of the above disclosures, alone or in combination, discloses or suggests either the article or the method of the present invention.

SUMMARY OF THE INVENTION

Briefly, one aspect of the present invention is a game card means or game card device comprising a matrix or array defined by connected lines and intersections with numeric indicia and blanks thereon. The matrix has a generally closed perimeter. The matrix of the present invention also has two and three-line peripheral or perimeter intersections and three-line internal intersections. At or between the two and three-line intersections, randomly-selected numbers and blanks are printed (or omitted) so that each individual intersection is uniquely designated by a combination of blanks and numbers.

In a preferred aspect of the invention, the matrix is formed using a polygon having translational symmetry. Translational symmetry, as used herein, simply means that an internally closed, regular and completely covering array may be generated by sequentially moving the polygon in two dimensions. For example, a pentagon does not have translational symmetry in contrast with squares and hexagons. Multiple polygons are used to define the matrix which may have essentially any desired peripheral shape. Thus, squares and hexagons can be chosen and employed to generate a game card device of the present invention.

Another aspect of this invention is a gaming method employing the above device. In this method, numbers are generated corresponding to the numerals and blanks on the device. As the numbers are generated, the intersection having the numbers are removed (in the same fashion) from said play. Victory is achieved when the covered intersections comprise e.g., a circle.

In yet another aspect of this invention, the above device is employed in a promotional method wherein all, or portions of, the intersections described are covered with an opaque, removable coating or material. The numbers at the various intersections or interstices are obscured by the removable opaque material. In the method of play, a particular number combination is designated as a win. The player then successfully wins (and receives the prize offered in the promotion) when he or she removes the opaque material over an intersection having the pre-designated winning combination.

BRIEF DESCRIPTION OF THE DRAWINGS

FIG. 1 is a listing of number combinations that can be used to form patterns of the present invention.

FIG. 2 is a listing of the numbers that can be randomly drawn if the device of the present invention were used to play the game of "ringer".

FIGS. 4*a* and 4*b* illustrate modes of play using a device of the present invention which is more completely described below.

FIG. 4*c* lists the random numbers drawn to illustrate the mode of play depicted in FIGS. 4*a* and 4*b*.

DETAILED DESCRIPTION OF THE INVENTION

Figure 3B:
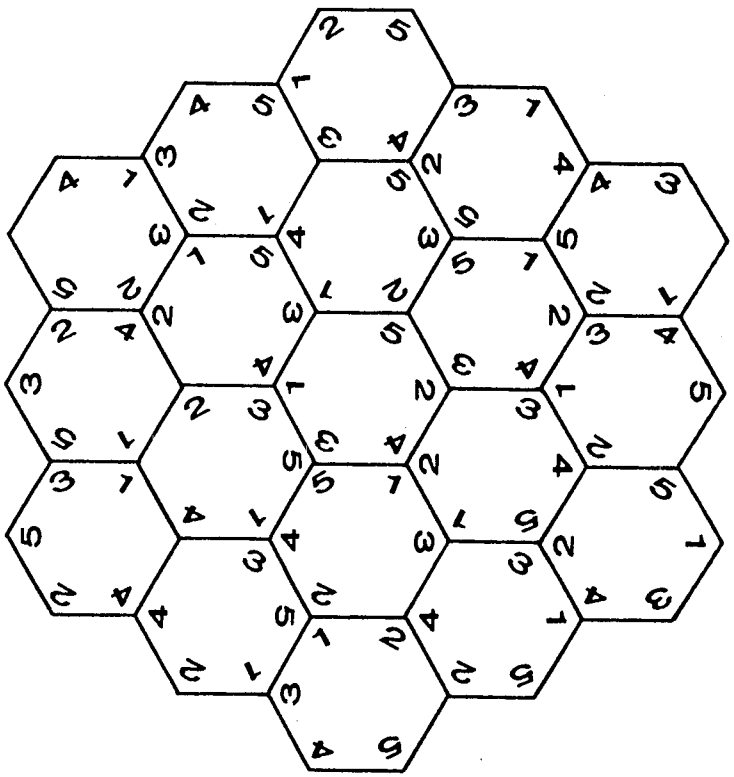
FIGS. 3*a* and 3*b* are matrices of the present invention.

FIG. 1 illustrates the unique number combinations possible using five individual numbers and "blanks" for distribution around the intersections or vertices of the preferred polygon, that is, a hexagon. An array of numbers depicted in FIG. 1 are individually unique in combination which could be used in numbering an array or matrix of hexagons. Hexagons individually have six intersections, all internal hexagonal members have intersections comprising three lines while peripheral members have an intersection comprising two lines.

Implicit in the list of numbers shown in FIG. 1 is a blank, since each have number arrays which when placed on the six vertices of a hexagon would, of necessity, provide such a blank. An array of hexagons in a particular shape could be numbered by picking combinations from FIG. 1 in some regular fashion, that is, proceeding from left to right horizontally across the vertical columns or, in the alternative, down the vertical column of numbers, a blank being inserted at each sixth intersection. By application of the numbers listed in FIG. 1, several matrices of the size shown in FIGS. 3*a*, 3*b*, 4*a* and 4*b* could be numbered. Moreover, by designation of a "top" on a particular game card device, a symmetric matrix could be rotated so that the number array would appear quite different even though the only actual difference would be a rotation from one matrix to another. This same result can be achieved by using the numbers listed in FIG. 1 and simply starting the numbering process at different points of a given symmetric matrix. An appropriately programmed computer coupled to a display could, of course, be used to generate arrays using the above-described numbering process as well as executing a renumbering step equivalent to physical rotation of the display/game card equivalent. Implicit in the above is that the number of possible combination may be increased or decreased to change the chances for a "win". For example, by adding a second set of numbers, e.g., 0-6-7-8-9-, the set of 55 number combinations shown in FIG. 2 will be increased to 284. These additional combinations will substantially reduce the likelihood that any particular game card would become a winner.

FIG. 2 is an array of numbers that would be used, for example, to generate the random listing of numbers for a game of "ringer". For example, the numbers listed in FIG. 2 could be affixed to ping-pong balls. The numbers could then be randomly selected and read to the participants in the game. As the numbers are read, the intersections having the corresponding numbers would be blocked out, removed, circled, or marked in some fashion indicating that they had been removed from play. Alternatively, the array of numbers shown in FIG. 2 could be stored in a computer and generated in random order. In this fashion, a small portable computer or an appropriately programmed larger table model computer could be used to generate both random numbers and a uniquely designated polygon in accordance with this invention. The apparatus would comprise a game card device of this invention and a computer-based, random number generator with appropriate auxiliary electronics.

Figure 3A:
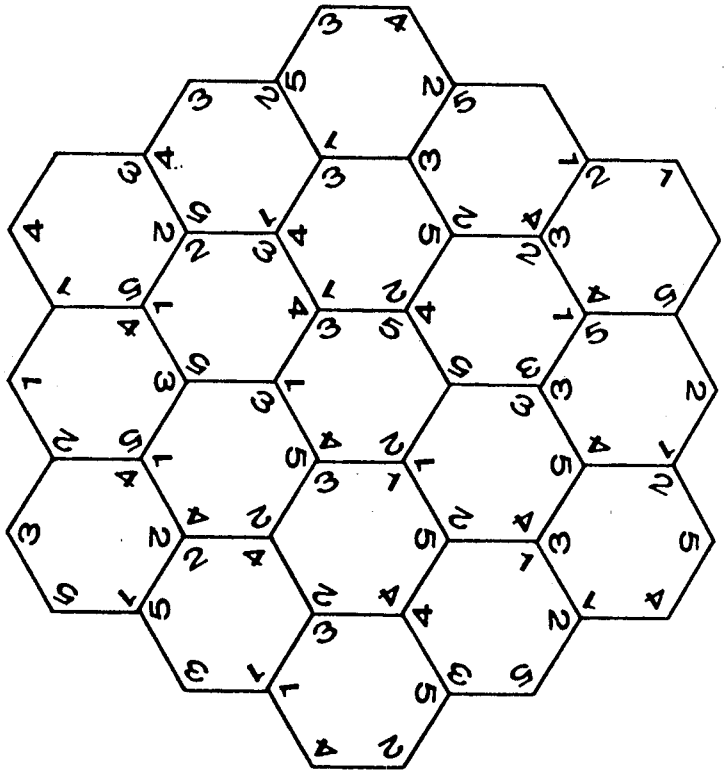

FIGS. 3*a* and 3*b* illustrate two number arrays, or matrices, of the present invention comprised of nineteen individual hexagons. Arrays 3*a* and 3*b* could be drawn and numbered by an appropriately programmed computer. Moreover, using the same principles, arrays with 37, 61, 96 or more numbered hexagons could be generated. Arrays could be generated having any desired periphery or shape. Regardless of the shape or number of internal interstices and therefor polygons, the same principles to play a game would be employed.

Focusing on FIGS. 4*a*, 4*b* and 4*c*, play of the game will now be illustrated.

FIG. 4*c* is a listing of numbers randomly drawn from those depicted in FIG. 2. As noted above, the numbers of FIG. 4*c* were randomly-selected or generated depending upon the mode of random number generation chosen. As the numbers are called, intersections having those numbers are marked in some fashion. For example, in FIG. 4*a* when the number "4" is called, all intersections having the number 4 were circled thereby removing them from play. These intersections are then removed from play. Analogously, all interstices with the number 5 are circled and removed from play when the number "5" is called or indicated on the computer-based game. The process continues until all intersections having the randomly-generated numbers thereafter are removed from play. As illustrated, the last listed number, 345, is circled and shown by arrow indicated "A".

Illustration of play, assume that the number 35 were the next number chosen after those listed in FIG. 4*c*. As indicated by arrow "B", 35 appears on both FIGS. 4*a* and 4*b*. When the player having card 4*a* circles 35 (indicated at arrow B), that player has obtained a sixth intersection "rounder" whereas the player having card 4*b* has merely obtained a five intersection "rounder". In this instance, the player having card 4*a* prevails. This illustrates one preferred mode of play wherein blank vertices (that is, vertices not having numbers in association therewith) are skipped, or not counted, when computing the number of vertices to determine the winner.

Illustrating another rule and preferred method of play using a game card of this invention, assume the number called after 345 were 15. In FIGS. 4*a* and 4*b*, the three-line vertex with the number 15 by it is indicated by arrow C. If both the players having cards illustrated in FIGS. 4*a* and 4*b* remove 15 after it is called, the player having the card depicted in FIG. 4*b* wins because that player, in one move, has achieved circles on two adjacent hexagons. For a given move resulting in a tie, the player that completes the most circles is declared the winner.

Figure 5:
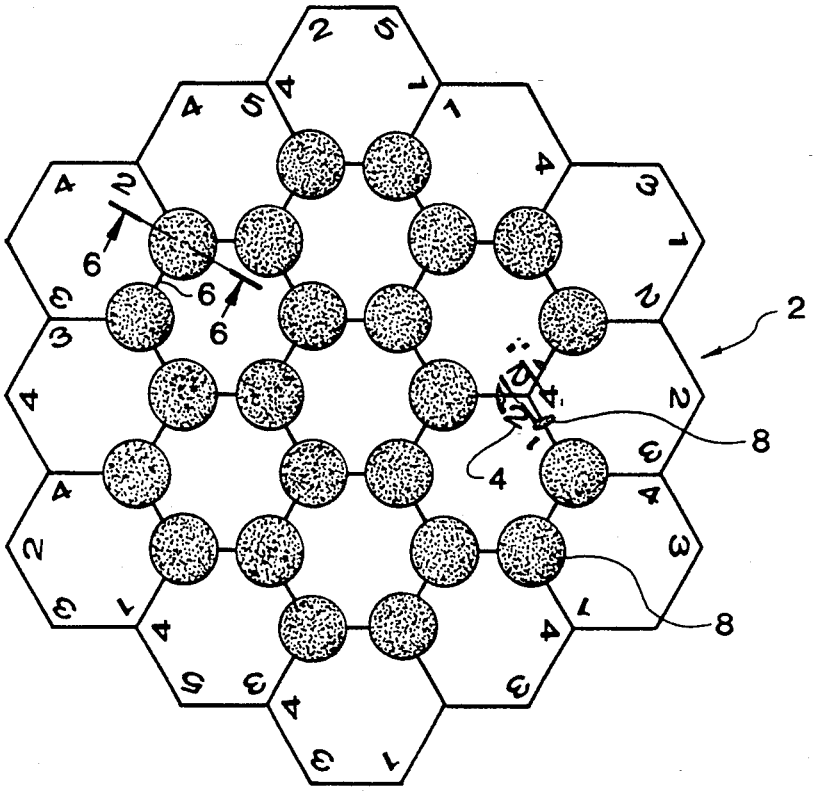
FIG. 5 is an embodiment of this invention using a removable opaque coating to hide a portion of the underlying matrix.

A method of utilizing the instant game card device in a promotion would likely employ an opaque but removable material on at least a portion thereof. FIG. 5 illustrates such a possible embodiment of the present game card in which an array such as that illustrated in FIGS. 4*a* and 4*b* is partially obscured by an opaque removable material. In this utilization of this instant invention, it might be necessary that only three-line interstices be employed. It will be understood, however, that, while the designation of a particular three-digit number as a "winner" might be typical, the invention specifically contemplates one or two-digit numbers serving as "winner" designations. Such "winner" designations would be met where one or two angle portions at an interstice are blank. For purposes of description, however, interstices having three digits will be discussed herein. This is illustrated in FIG. 5 by the two-line and three-line interstices having been left uncovered.

In this mode of play, a winning number is selected and made known. Participants then receive a game card of the present invention and select one, or a designated larger number of, interstices which may be uncovered by scraping the opaque material therefrom. As illustrated in FIG. 5, if the number 224 has previously been designated a "winner", then the holder of the promotional device having the game of the present invention with the designated intersection has won. In order to avoid the possibility of fraud, the game array matrix would, of necessity, be made secure by employing a suitably thick substrate or paper backing or other means to prevent identification of the numbers beneath the blackened areas before the opaque material has been removed. It should be noted, in this preferred practice of the present invention, there are 24 non-peripheral interstices on each card. In order to increase the likelihood of winning, and therefore, the excitement associated with play, it may be necessary to designate in advance several numbers as "winners" in order to obtain greater public interest in utilization of the present device.

Figure 6:
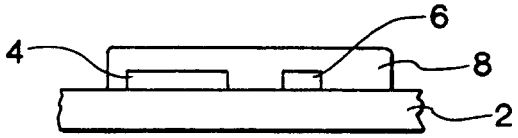
FIG. 6 is a cross-section view taken along line 6—6 of FIG. 5.

FIG. 6 illustrates an intersection of the present invention in exaggerated section. As is shown in FIG. 6, a substantially thick and light stopping substrate 2 has printed thereon a number 4 and, at least, a portion of the line of the array 6 covering both number 4 and matrix line 6 is an opaque but removable material 8. As is shown on the right side of FIG. 3 (at approximately three-o'clock) is an array of numbers 224 with opaque material partially removed therefrom.

Figure 7:
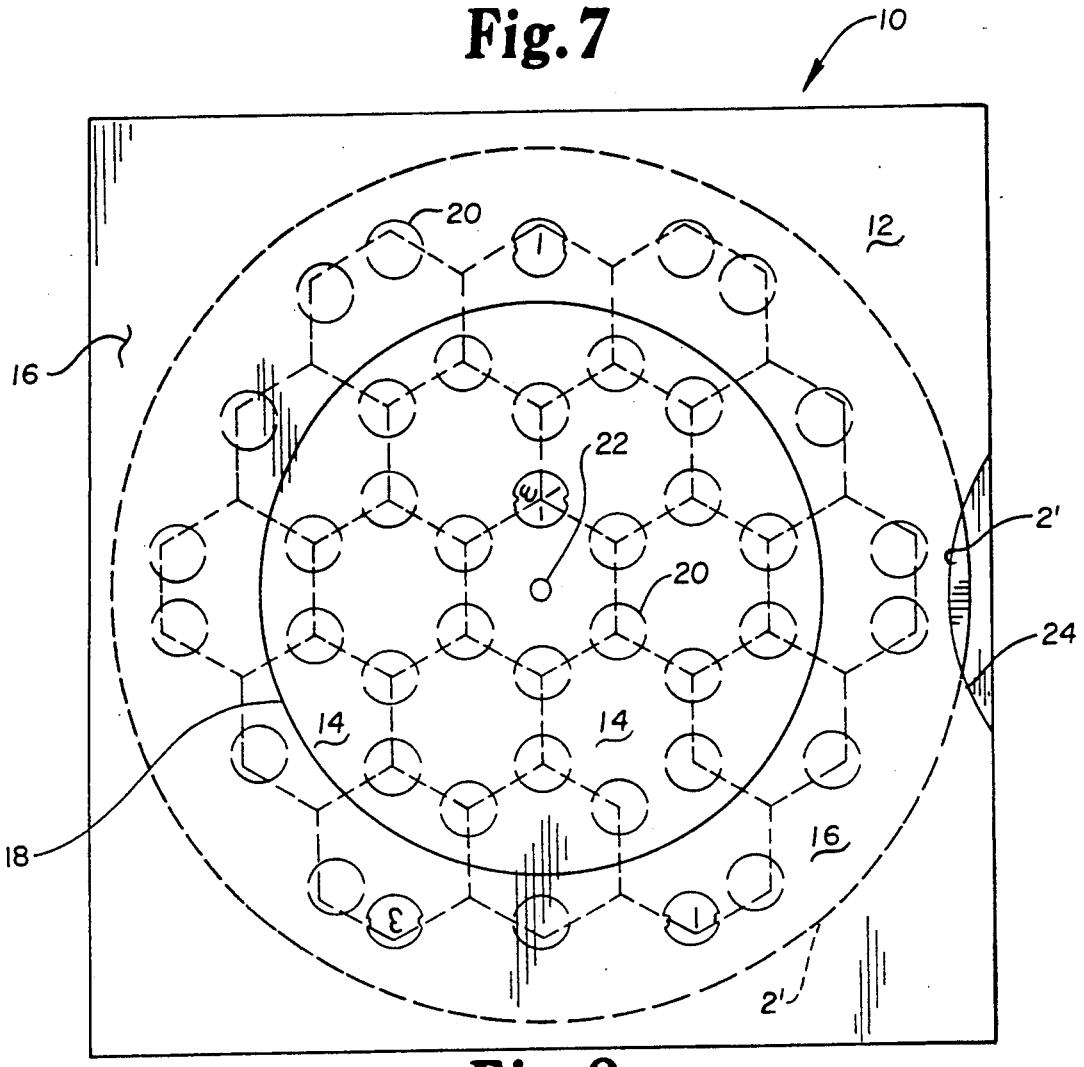
FIG. 7 is a top plan view of a further embodiment of the invention

Two further embodiments of this invention are shown in FIG.'s 7–10. In FIG. 7 there is shown a multiple panel envelope, box, game apparatus or article 10. Depending upon the user's intent, a relatively flat (i.e., substantially two dimensional) game apparatus, such as an envelope, to a relatively thicker three dimensional apparatus, such as a box, may be employed. A game card of this invention would be enclosed within and displayed by the selected two dimensional or three dimensional apparatus. While size is not critical, a 6 inch to 8 inch by 6 inch to 8 inch box from 1 to 3 inches deep would be typical. In the case of a box, for example, the apparatus could be upstanding and sit or be placed upon a surface during play.

Apparatus 10 comprises a normally square or rectangular face 12 which partially obscures or covers circular game card device 2' of this invention. In this version game card device 2' is a circular disc and is largely shown in phantom in FIG. 7. Face 12 includes an inner field 14 and an outer field 16, inner field 14 and outer field 16 being separated by a boundary line 18. In this embodiment boundary 18 is a circle. Disposed on inner field 14 and outer field 16 are perforate "punch out" holes 20 which, when removed, permit a player to see game card device 2'. Game card device 2' is disposed about an axle 22 and can be rotated thereabout. Face 12 has cut out 24 which provides user access to disc 2 to permit disc 2' to be rotated about axle 22', e.g., by means of the finger of a player.

Figure 8:
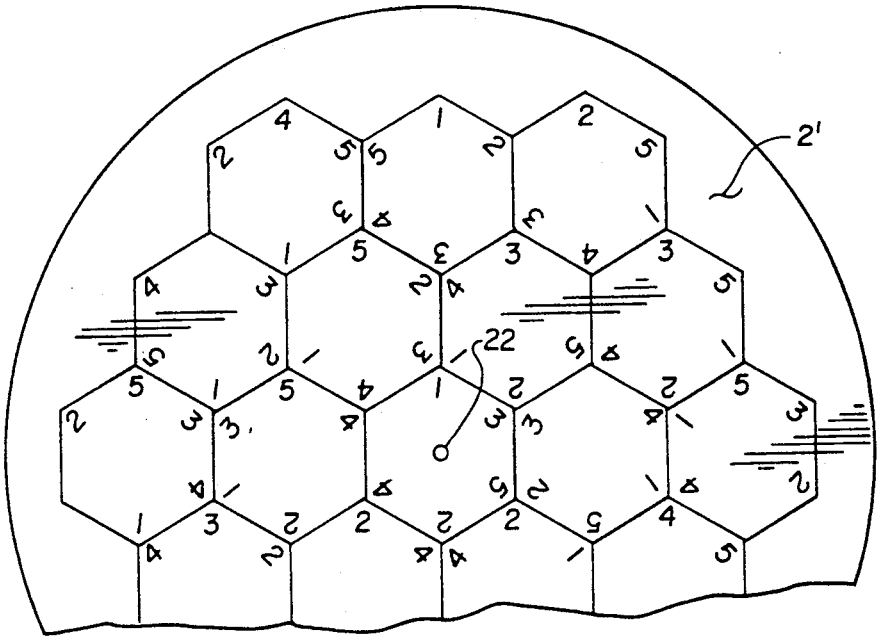
FIG. 8 is a top plan fragmentary view thereof showing a detail of the rotatable disk of the embodiment of FIG. 7.

FIG. 8 shows in partial sections, game card device or disc 2' which is largely shown in phantom in FIG. 7. Game card device 2' is numbered in a fashion similar to that of FIG. 3*a* and 3*b*, with the exception that it has been printed on a rotatable disc 2'. Boundary 18, which separates the inner and outer fields (on face), is of a size where the outer-most numbers of the card of the matrix are in registration so as to fall beneath the punch out holes in the outer field of face 12.

Play of the game proceeds as described above.

Figure 9:
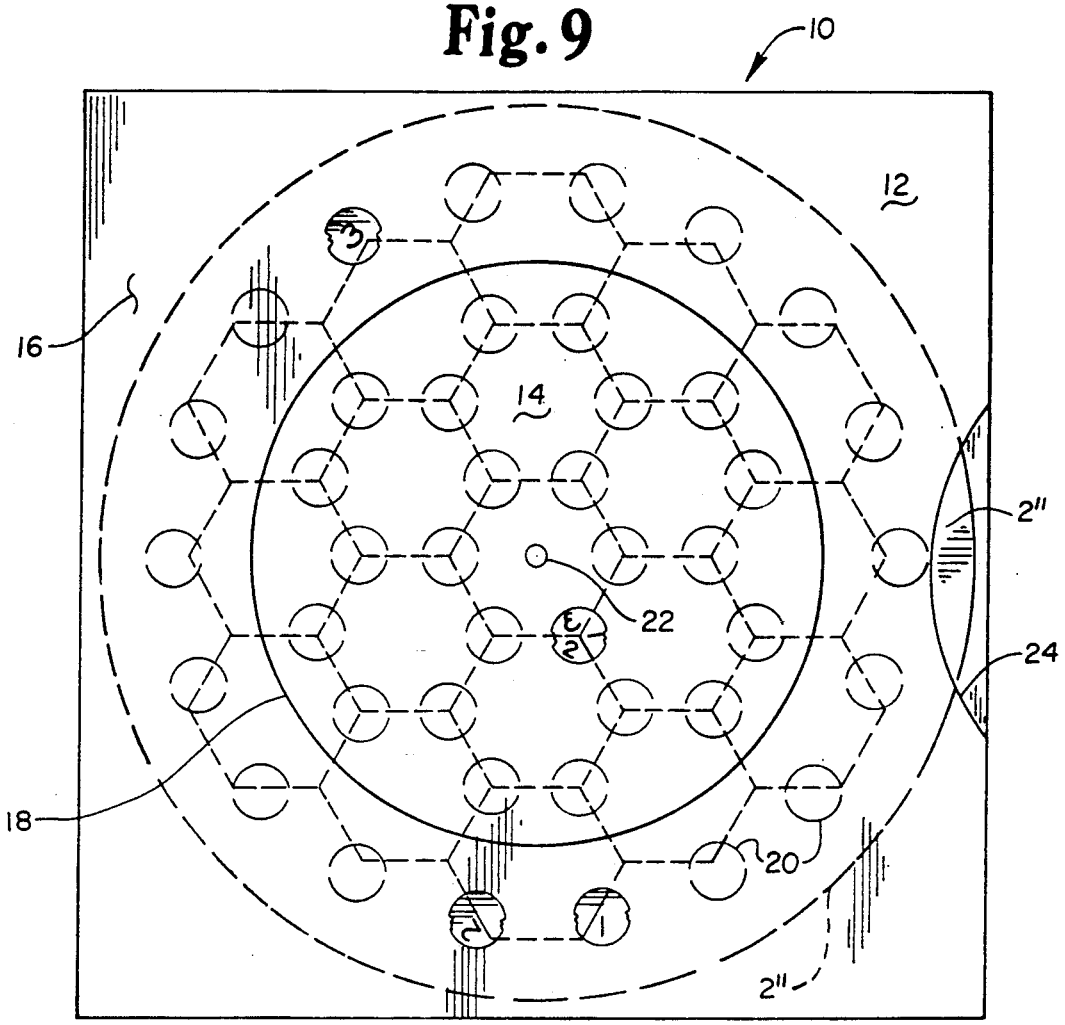
FIG. 9 is a top plan view of yet a further embodiment of the invention.
Figure 10:
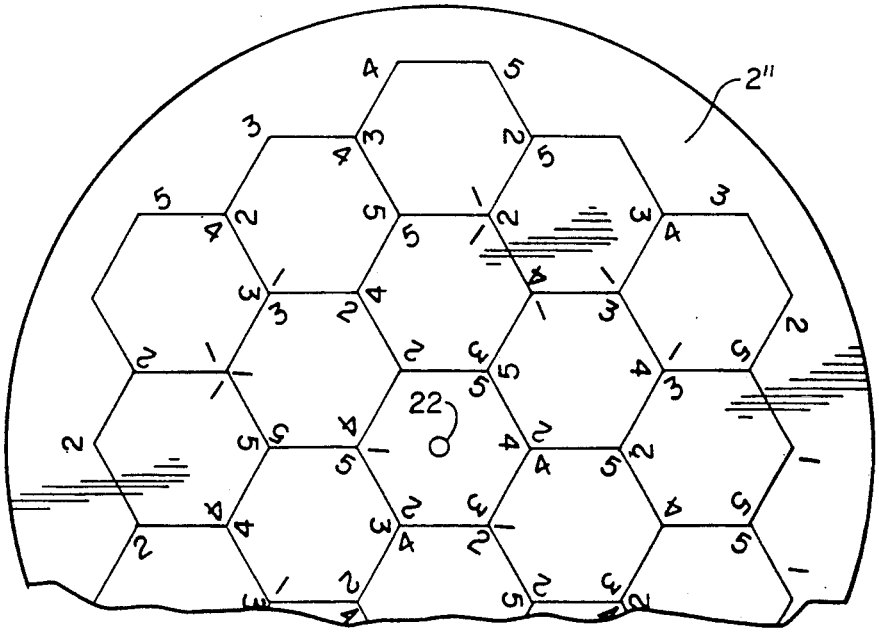
FIG. 10 is a top plan fragmentary view thereof showing a rotatable disk of the embodiment of FIG. 9.

FIGS. 9 and 10 illustrate a variation of the game apparatus illustrated in FIGS. 8 and 9. In the embodiment shown, "punch outs" or "cut outs" were selected for game card device 2'' has an array of interstices with a different combination of numbers and blanks.

Figure 11:
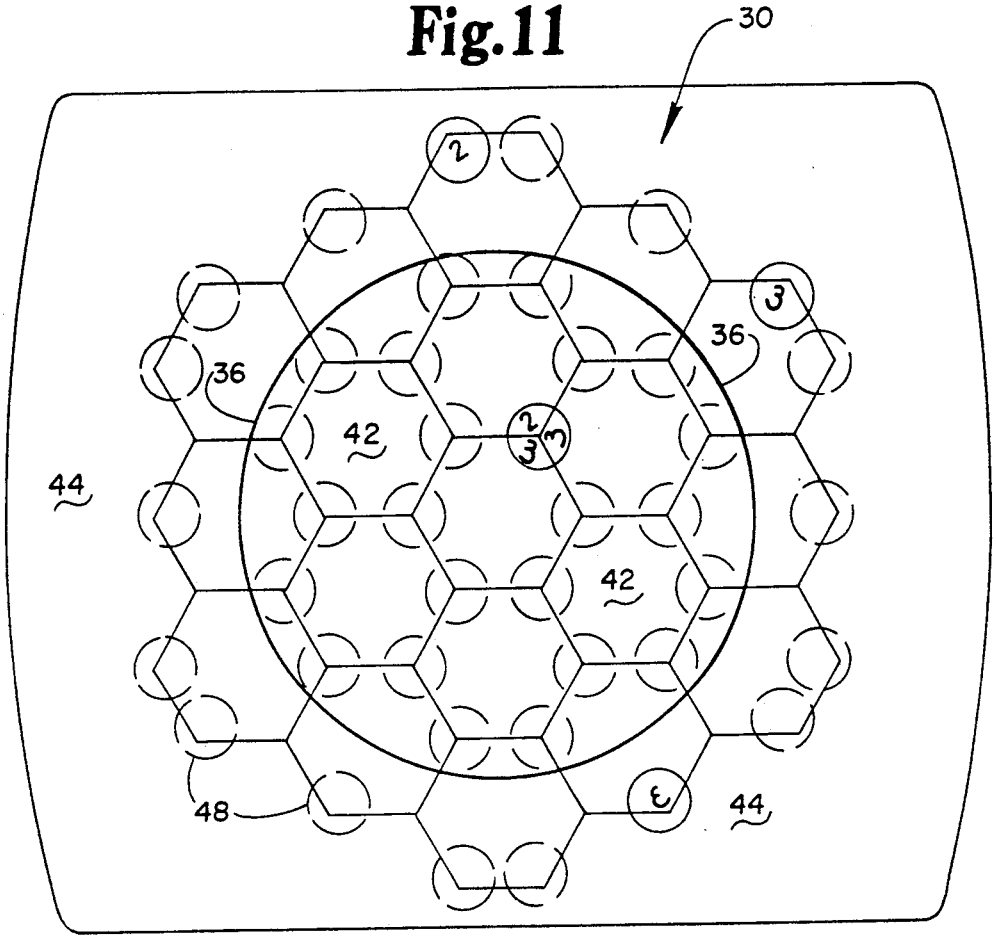
FIG. 11 is a profile view of touch screen display embodiment of this invention.
Figure 12:
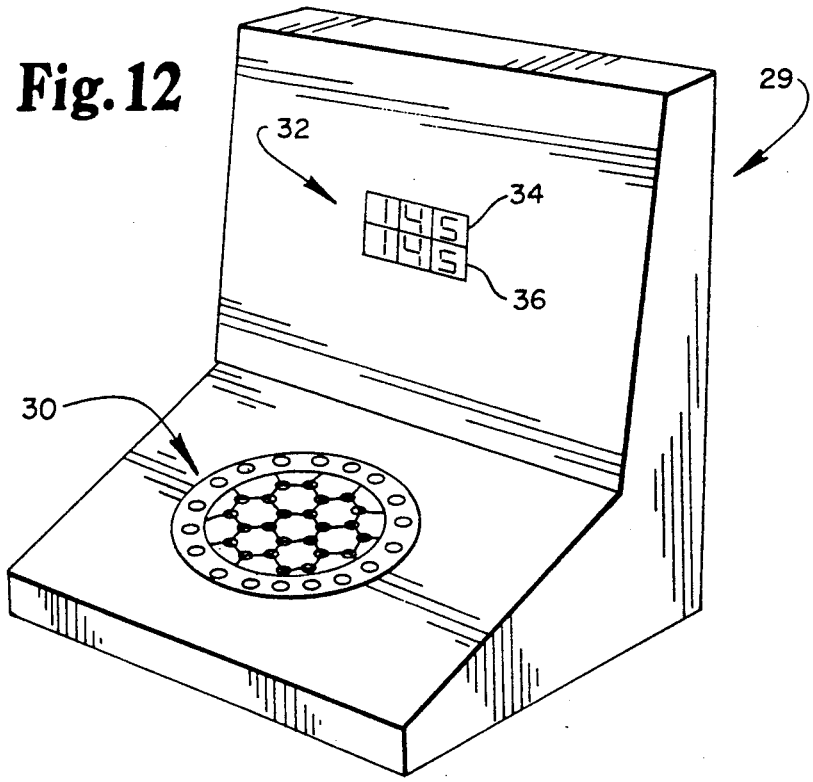
FIG. 12 is a perspective view of an electronic casino cabinet and display alternative embodiment thereof.

FIGS. 11 and 12 depict a further embodiment of the invention in which an electronic device is used to play the game. The electronic device 29 comprises a touch activated pad, keyboard, game display, or screen 30 and a number display 32. Keyboard 30 has an electronic game means or game device programmed or preprogrammed therein, with the numbers unlit. Number display 32 has registers 34, 36 which display numbers "punched" or "touched" on electronic touch activated keyboard or array 30. Keyboard array 30 is the electronic equivalent of the above-described game card. Pad 30 has inner and outer fields 42, 44 separated by boundary 36. Thus, touch activated pads 48, when touched, generate numbers which are stored and displayed in registers 34, 36. In this play, a player touches or punches one pad from inner field 42. This generates a 1 to 3 digit number with 1 to 3 number equivalents (e.g., asterisks) which is displayed in e.g., upper register 34. Upon touching a pad, a player will always see a number or an asterisk in number register 32 because this 1 to 3 digit designator becomes that player's "key" number. The player then punches or touches 3 numbers from outer field 44, which are displayed in e.g., register 36. The more ordered and matched are the key numbers from the inner field and the single digit numbers from the outer field, the greater the "win". Three matching numbers in the same sequence constitutes the greatest win. In this version of play, a spectrum of "wins" may be defined. Particular number combinations, short of a complete match (e.g., 3 of one number and 3 of a second number) can be designated as a "win". Utilization of a computer-generated "game card" or game card means permits each and every "play" to be different. In this manner, literally hundreds (or thousands) of game configurations can be stored or programmed into the electronic device and programmed to the pad configurations to be called into play when a game commences. It will, of course, be recognized that the game card equivalent of the above computer generated play would be a circular array with inner and outer fields and numbers with removable opaque material. Play would be commenced by scraping the opaque material from one number from the inner field and three numbers from the outer field. Applying the previously agreed-upon definition of a win, victory (or further play) can be determined.

Those of skill in this art will recognize many of the possible methods of utilizing the present number card game device. These variations and extensions of the present invention should be considered to be within the scope of the attached claims.

What is claimed is as follows:

1. A game apparatus comprising:

a game card means, the game card means comprising a matrix with numerical indicia and blanks thereon, the matrix having a generally closed perimeter having therein a plurality of intersecting lines defining a plurality of interconnected two and three-line peripheral and three-line internal interstices, each of said interstices having a plurality of angular portions, said numerical indicia and blanks being randomly selected and disposed on the angular portions of each of said interstices, wherein each angular portion either carries a numerical indicia or a blank with no indicia, wherein any interstice forms a random combination of numbers and blanks.

2. A game apparatus according to claim 1 which further comprises a face card overlaying the game cards means, the face card having a plurality of removable segments in registration with the numerical indicia of the game card means, which, when removed reveal numerical indicia on the game card means.

3. A game card means according to claim 1 wherein the matrix comprises polygons having translational symmetry.

4. A game card means according to claim 3 wherein the polygon is a hexagon.

5. A game card device according to claim 1 wherein the numbers are selected from the numbers 0 through 9.

6. A method of playing a game comprising the steps of:

a. obtaining a game apparatus, said game apparatus including a game card means, said game card means including a matrix with numerical indicia and blanks thereon, the matrix having a generally closed perimeter having therein a plurality of intersecting lines defining a plurality of interconnected two and three-line peripheral and three-line internal interstices, each of said interstices forming a plurality of angular portions, said numerical indicia, and blanks being randomly selected and disposed on the angular portions of each of said interstices, each angular portion either carrying a numerical indicia or a blank with no indicia, wherein any interstice forms a random combinations of numbers and blanks;

b. designating a desired path of contiguous interstices as a victory;

c. generating and calling out a plurality of random combinations of numbers corresponding on the game card device;

d. specifically denoting each interstice which has a random combination of numbers identical to a randomly generated combination of numbers is called; and e. when the desired path of contiguous interstices is denoted, determining a winner.

7. A game card comprising a generally planar surface having a matrix printed thereon, said matrix including a plurality of polyons interfitted to define a multiplicity of interstices formed by adjacent angular portions of contiguous polygons, a plurality of numbers and blanks being randomly disposed on said angular portions, wherein each angular portion either carries a randomly selected number or blank with no number, said game card further including a face card overlying said game card, said face card having a plurality of removable segments in registration with the interstices and the numbers and blanks associated therewith.

8. A game card according to claim 7, wherein the numbers are selected from 0 through 9.

* * * * *